United States Patent [19]

Schofield

[11] 4,347,878

[45] Sep. 7, 1982

[54] FUNNEL

[76] Inventor: Miles E. Schofield, 5949 Melvin Ave., Tarzana, Calif. 91356

[21] Appl. No.: 167,646

[22] Filed: Jul. 11, 1980

[51] Int. Cl.[3] ..... B65B 39/04

[52] U.S. Cl. ..... 141/300; 141/334; 141/340

[58] Field of Search ..... 141/331-345, 141/299, 300

[56] References Cited

U.S. PATENT DOCUMENTS

| | | | |
|---|---|---|---|
| 427,874 | 5/1890 | Jones | 141/340 |
| 1,487,824 | 3/1924 | Vincent | 141/340 |
| 2,260,430 | 10/1941 | Blasingame | 141/334 |
| 3,927,703 | 12/1975 | Beaubien | 141/333 |

FOREIGN PATENT DOCUMENTS

| | | | |
|---|---|---|---|
| 149895 | 4/1951 | Australia | 141/334 |

*Primary Examiner*—Frederick R. Schmidt

*Attorney, Agent, or Firm*—Fulwider, Patton, Rieber, Lee & Utecht

[57] ABSTRACT

A funnel has a relatively wide-mouthed bowl for receiving a liquid such as gasoline or the like. The bowl communicates the liquid for gravity flow downwardly through an angularly disposed central section, and further through a relatively small-mouthed spout sized for reception into a suitable receptacle, such as the filler pipe of an automotive vehicle fuel tank. The central section is formed to define a wedge-shaped configuration for binding reception partially into the receptacle, and further to define a flow path for venting air from the receptacle while the receptacle is being filled with the liquid.

4 Claims, 3 Drawing Figures

FUNNEL

BACKGROUND OF THE INVENTION

This invention relates in general to funnels for guiding a poured liquid into a desired receptacle without spillage. More particularly, this invention relates to an improved funnel construction having a wide variety of uses, but which is specifically adapted for guiding a liquid fuel such as gasoline into the fuel tank of an automotive vehicle.

Funnels in general are well known in the prior art and typically comprise a relatively wide-mouthed upper bowl-shaped portion for receiving the liquid to be poured into a receptacle. The bowl portion of the funnel communicates the liquid for flow downwardly by means of gravity through a relatively small-mouthed lower spout sized for reception into the receptacle.

In use, the funnel spout is inserted into the desired receptacle, and the liquid is poured directly into the bowl-shaped portion. However, the spout provides a relatively unstable support structure for the larger, bowl-shaped portion, whereby pouring of the liquid into the bowl-shaped portion tends to cause the funnel to shift under the weight of the liquid. All too frequently, this shifting of the funnel results in undesired spillage of the liquid. When the liquid comprises a volatile substance such as gasoline, this likelihood of spillage is highly undesirable and dangerous.

In the prior art, therefore, it has been necessary for the user of a funnel physically to hold the funnel with one hand to keep the funnel from shifting positions as the liquid is poured. With one hand occupied, the user has but one remaining hand for operating the particular liquid dispensing apparatus such as a gasoline pump dispensing nozzle, a gasoline storage can, or the like. Accordingly, these typical prior art funnels are cumbersome to use and subject the user to potentially dangerous spillage of liquid.

Some prior art funnels have been designed which attempt to avoid the requirement that the user hold the funnel in position with one hand while pouring a liquid. For example, it has been proposed to form a funnel from a somewhat resilient thermoplastic material whereby the funnel may be jammed partially into the receptacle in an attempt to secure the funnel during pouring of a liquid. However, these types of funnels tend to creep steadily out of the receptacle by virtue of their natural resilience. Accordingly, it is frequently necessary to hold a funnel of this type with one hand to assure that the funnel stays in place during pouring of a liquid.

Another problem encountered with prior art funnels is that they tend to seal the receptacle against evacuation of air as the receptacle is filled with liquid. Since this air must escape before the receptacle can be filled with liquid, the air typically bubbles through the inflowing liquid. This counterflow action of air and liquid undesirably results in a relatively reduced flow rate of liquid into the receptacle.

The present invention overcomes the problems and disadvantages of the prior art by providing an improved funnel configured for partial reception into a receptacle in binding engagement therewith to secure the funnel during pouring of a liquid. Moreover, the funnel is configured to define a separate flow path for venting of air from the receptacle as the receptacle is filled with liquid.

SUMMARY OF THE INVENTION

In accordance with the invention, an improved funnel is provided wherein the funnel is configured for guiding rapid flow of a liquid into a receptacle without spillage. The funnel construction is specifically designed for handling volatile liquids, such as gasoline or other fuels, and for guiding the fuel into an appropriate receptacle such as the fuel tank of an automotive vehicle.

The funnel of this invention comprises a relatively wide-mouthed upper bowl for receiving a liquid such as gasoline or the like. The bowl has a relatively steep and generally inverted conical configuration, and communicates downwardly with an angularly disposed central section. In turn, the central section communicates further downwardly with a generally coaxial and relatively small-mouthed spout sized for easy reception into a desired receptacle, such as the conventionally inclined filler pipe of an automobile fuel tank. The angular relationship of the bowl with the central section and the spout is chosen to orient the bowl in an approximately upwardly open position.

The central section of the funnel includes a pair of longitudinally extending opposed surfaces which together define a generally wedge-shaped profile for binding reception partially into the receptacle. These wedge-forming surfaces can be roughened as by a knurling process to enhance the gripping engagement with the receptacle to secure the funnel in the desired position. Moreover, the central section includes at least one radially inwardly recessed surface generally between the wedge-forming surfaces and shaped to define a venting air flow path between the exterior of the funnel and the receptacle when the funnel is received partially into the receptacle. With this configuration, air within the receptacle is evacuated from the receptacle during filling with liquid without interrupting the liquid flow.

Other features and advantages of the present invention will become apparent from the following detailed description, taken in conjunction with the accompanying drawings, which illustrate by way of example the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
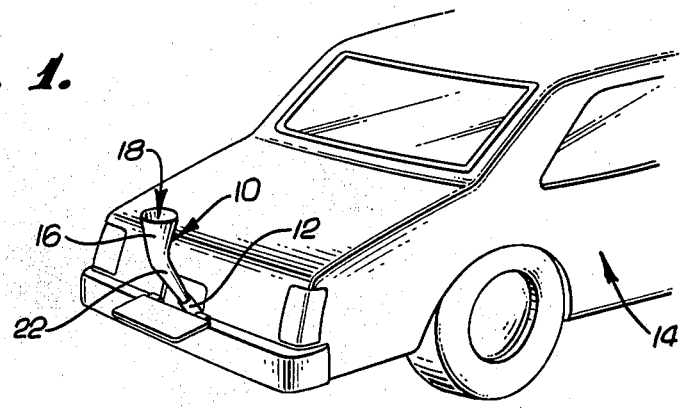
FIG. 1 is a fragmented perspective view illustrating use of a funnel of this invention for guiding gasoline into the fuel tank of an automotive vehicle.

A funnel 10 is shown generally in FIG. 1 received into the open end of a filler pipe 12 for guiding a fuel such as gasoline into a fuel tank (not shown) of an automotive vehicle 14. The funnel 10 is designed for easy reception into the filler pipe 12 in binding engagement with the pipe 12 so as to firmly secure the funnel in an upwardly open position for easy reception of the fuel. Moreover, the funnel 10 is configured to define at least one air flow path between the exterior surfaces of the funnel and the filler pipe 12 for venting of air from the fuel tank without interrupting the flow stream of liquid fuel through the funnel into the tank.

Figure 2:
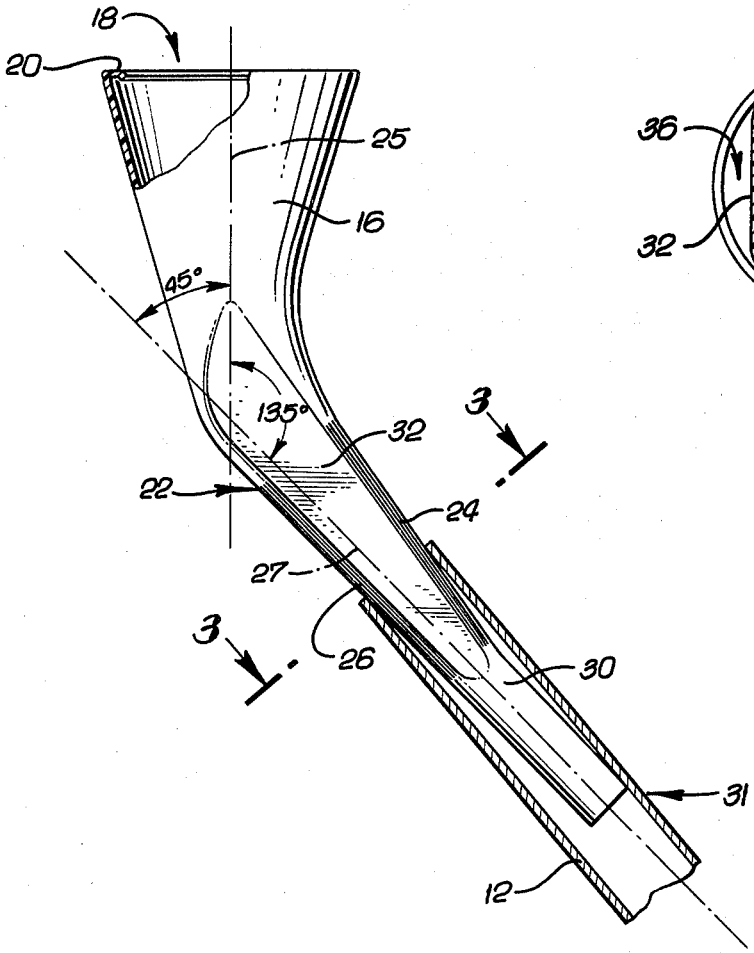
FIG. 2 is an enlarged elevation view of the funnel with portions broken away and showing the funnel inserted partially into the filler pipe of an automotive vehicle fuel tank.
Figure 3:
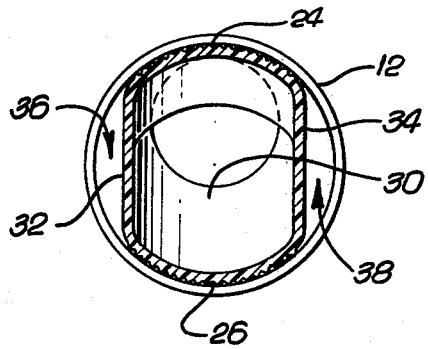
FIG. 3 is an enlarged section taken on the line 3—3 of FIG. 2.

The funnel 10 of this invention is illustrated in more detail in FIGS. 2 and 3. As shown the funnel 10 is formed to have a unitary or one-piece hollow construction which can be formed conveniently by suitable blow molding equipment. The funnel is constructed from a relatively rigid material which is generally impervious to solvents, such as for example a relatively rigid-setting polyethylene plastic.

The funnel 10 is shaped to have an upper bowl 16 with a relatively wide-mouthed and upwardly presented opening 18 for receiving a liquid as it is poured. This bowl is formed preferrably in the shape generally of an inverted cone for easy reception of a liquid such as gasoline at a relatively rapid flow rate with a minimum of splashing. Conveniently, as illustrated in FIG. 2, the opening 18 is bounded by a radially inwardly presented flange 20 which also functions to minimize splashing of liquid from the bowl 16 and which serves to strengthen the funnel structure.

The bowl 16 blends downwardly and integrally with a central section 22. This central section 22 is shaped for partial reception into the filler pipe 12 in binding engagement with the filler pipe to firmly secure the entire funnel in the desired position. In turn, the central section 22 blends downwardly and integrally with an aligned and generally cylindrical spout 30 sized for easy reception into the filler pipe 12. Both the central section 22 and the spout 30 define flow paths for passage of the liquid from the bowl 16 downwardly by gravity into the filler pipe 12.

More specifically, the central section 22 has an upper surface 24 and a lower surface 26 each of arcuate cross section and formed substantially on a common radius. The two surfaces 24 and 26 extend for substantially the length of the central section 22 with the upper surface 24 converging gradually toward the lower surface 26 from the upper end of the central section 22 toward the lower end. Accordingly, the upper and lower surfaces 24 and 26 define surfaces of arcuate cross section which together present a generally wedge-shaped profile.

The central section 22 is sized to provide a wedge profile of gradual taper for partial reception into the filler pipe 12 with its upper and lower surfaces 24 and 26 in binding frictional engagement with the interior of the filler pipe. This binding engagement is stabilized by abutting contact between the end of the spout 30 with the interior of the pipe 12, as illustrated at 31. Of course, with a filler pipe having a diameter smaller than that illustrated in FIG. 2, the central section 22 will not fit as far into the filler pipe. Alternately, with a filler pipe of relatively larger diameter, the center section 22 will fit further into the filler pipe before the surfaces 24 and 26 are brought into binding engagement with the filler pipe. Conveniently, for improving the frictional gripping relationship of the surfaces 24 and 26 with the filler pipe, these surfaces can be roughened, as illustrated by the knurling in FIGS. 2 and 3, over a substantial portion of the length of the central section 22.

The central section 22 is angularly set with respect to the centerline of the bowl 16, as illustrated at 25 in FIG. 2. More specifically, the filler pipe 12 for guiding fuel into the fuel tank of an automotive vehicle is typically inclined with respect to the horizontal direction. This inclination is illustrated in FIG. 2 and typically comprises an angle of about 45°. The bowl 16 of the funnel 10 of this invention is therefore angularly disposed at an obtuse angle with respect to the centerline of the central section 22, as illustrated at 27 in FIG. 2. In a preferred embodiment of the invention, this obtuse angle is chosen to be about 135° whereby the bowl 16 may be oriented in a generally vertically extending and upwardly open position for reception of liquid.

The upper and lower arcuate surfaces 24 and 26 of the central section 22 are joined by a pair of oppositely disposed and generally parallel flat sides 32 and 34. These flat sides 32 and 34 are oriented to be spaced radially inwardly from the filler pipe 12 over a portion of the periphery of the central section 22 to define air vents 36 and 38 on opposite sides of the funnel. These air vents 36 and 38 comprise air flow paths for passage of air evacuating from the tank as the liquid is poured through the funnel into the tank. In this manner, the evacuating air does not interfere with the incoming liquid flow stream, and thereby does not inhibit the rate of filling of the tank.

The funnel 10 of this invention is quickly and easily inserted into a receptacle such as the filler pipe 12 of an automotive vehicle fuel tank. The knurled surfaces 24 and 26 of the funnel central section 22 define a wedge-shaped profile providing relatively extensive surface areas which combine with the contact between the end of the spout 30 with the pipe for binding and supportive engagement with the filler pipe to securely and firmly retain the funnel in the desired stable orientation while a liquid is poured therethrough. The angular relationship between the central section 22 and the bowl 16 enables the bowl to be retained in a generally upwardly open position for easy reception of the liquid. Moreover, the flat sides 32 and 34 of the funnel central section define vent flow paths for passage of air from the receptacle so as to facilitate rapid and easy filling of the receptacle.

In a preferred embodiment of the funnel 10 of this invention, the bowl 16 is sized to receive a typical gasoline dispensing nozzle. When the nozzle is provided with a bellows-shaped vapor control mechanism, the vapor control mechanism reacts against the inner surfaces of the bowl 16 to allow the gasoline to be dispensed from the nozzle in a normal manner into the funnel. The central section 22 is sized to have a gradual taper for maximizing wedging action for securely supporting the funnel in position. For example, in one embodiment the central section 22 was formed to have a length of about eight inches, and the upper knurled surface 24 was formed to have a length of about eight inches and an angle of about 14° with respect to the centerline 27. Of course, the spout 30 of the funnel 10 is sized for appropriate reception into the filler pipe 12 of modern automotive vehicles wherein the filler pipe has a relatively reduced cross-sectional size to comply with governmental regulations limiting the type of fuel, such as unleaded gasoline, which can be used to power the vehicle.

The funnel of this invention thus provides a relatively deep bowl 16 together with an elongated central section of gradual taper and a relatively small spout 30. The gradually tapering central section 22 allows the funnel to be used in a variety of applications such as, for example, instances wherein the proximity of an automobile bumper or body to the filler pipe 12 prevents wedging action of the knurled surfaces 24 and 26 directly with the filler pipe. In such cases the elongated and gradual taper of the funnel central section allows the central section to wedge with one of the knurled surfaces against the filler pipe and the other against the bumper or the like to retain the funnel in a secure and stable position.

A variety of modifications and improvements to the funnel construction set forth in this application are believed to be apparent to one skilled in the art. For example, it can be appreciated that the funnel construction of this invention is readily adaptable for use with a variety of liquids to be guided into a variety of different types of receptacles. Moreover, the flat surfaces 32 and 34 defining the air vents 36 and 38 can be modified to form virtually any non-circular cross section to allow venting of air between the periphery of the funnel and the filler pipe. Accordingly, no limitation on the invention is intended, except as set forth in the appended claims.

What is claimed is:

1. A funnel for receiving a poured liquid, and for guiding the liquid into an elongated filler pipe for flow into a receptacle, comprising:

a relatively wide-mouthed bowl for receiving the poured liquid;

a central section formed integrally with said bowl and defining a flow path communicating with the interior of said bowl for receiving the liquid from said bowl; and a generally cylindrical spout of relatively small cross section for reception into the filler pipe, said spout being formed integrally with said central section generally opposite said bowl, and defining a relatively small flow path communicating with the flow path through said central path communicating with the flow path through said central section for passage of the liquid through said spout and into the filler pipe;

said central section and said spout being formed generally in alignment with each other and angularly disposed at an obtuse angle with respect to said bowl, said central section including a pair of generally opposed surfaces of arcuate cross section extending for a substantial portion of the length of said central section and converging gradually from said bowl toward each other to define a generally wedge-shaped profile, said wedge-shaped profile being of sufficiently small cross section at its end adjacent said spout for reception at least partially into the filler pipe with said opposed arcuate surfaces in binding engagement with the filler pipe and with the end of said spout opposite said central section in abutting engagement with the interior of the filler pipe, said central section further including at least one relatively flat side extending between said opposed arcuate surfaces to define an air vent between the exterior of said central section and the filler pipe when said central section is received partially into the filler pipe.

2. The funnel of claim 1 wherein said central section and said spout are formed at an angle of about 135° with respect to said bowl.

3. The funnel of claim 1 wherein said arcuate surfaces are knurled.

4. The funnel of claim 3 wherein said arcuate surfaces comprise an upper surface, presented generally in the direction of opening of said bowl, and a lower surface, said upper surface extending from said bowl angularly in a direction converging toward said lower surface to form said wedge-shaped profile.

* * * * *